US006401306B1

(12) United States Patent
Hanten et al.

(10) Patent No.: US 6,401,306 B1
(45) Date of Patent: Jun. 11, 2002

(54) SEALING CLIP FOR BAGS AND TUBES, AND MATRIX FOR SEALING THE LATTER

(75) Inventors: Jürgen Hanten, Rockenberg; Gerhard Lapp; Manfred Metzler, both of Frankfurt am Main; Jürgen Reitz, Eschborn; Günter Vermehren, Usingen, all of (DE)

(73) Assignee: Poly-Clip System GmbH & Co. KG, Frankfurt am Main (DE)

( * ) Notice: Subject to any disclaimer, the term of this patent is extended or adjusted under 35 U.S.C. 154(b) by 0 days.

(21) Appl. No.: 09/341,448

(22) PCT Filed: Jan. 6, 1998

(86) PCT No.: PCT/EP98/00022

§ 371 (c)(1),
(2), (4) Date: Jul. 9, 1999

(87) PCT Pub. No.: WO98/30460

PCT Pub. Date: Jul. 16, 1998

(30) Foreign Application Priority Data

Jan. 11, 1997 (DE) ..... 197 00 692

(51) Int. Cl.[7] ..... B65D 77/10

(52) U.S. Cl. ..... 24/30.5 W; 24/30.5 R; 24/20 CW; 24/20 W

(58) Field of Search ..... 24/30.5 N, 30.5 R, 24/20 CW, 27, 20 W, 115 A

(56) References Cited

U.S. PATENT DOCUMENTS

| | | | | | |
|---|---|---|---|---|---|
| 104,183 | A | * | 6/1870 | Miles | 411/920 |
| 104,184 | A | * | 6/1870 | Miles | 411/920 |
| 239,737 | A | * | 4/1881 | Dean | 411/920 |
| 300,204 | A | * | 6/1884 | Brainard | 411/920 |
| 503,264 | A | * | 8/1893 | Davidson | 411/920 |
| D29,472 | S | * | 10/1898 | Hughes et al. | 411/920 |

(List continued on next page.)

FOREIGN PATENT DOCUMENTS

| | | | |
|---|---|---|---|
| CH | 447109 | | 11/1967 |
| DE | 2605671 | | 8/1977 |
| DE | 3715626 | | 12/1988 |
| DE | 37 15 626 | A1 * | 12/1988 |
| EP | 199154 | | 10/1986 |
| EP | 0 541 950 | A1 * | 10/1992 |
| WO | 8500792 | | 2/1985 |

*Primary Examiner*—Anthony Knight
*Assistant Examiner*—Ruth C. Rodriguez
(74) *Attorney, Agent, or Firm*—Norris McLaughlin & Marcus

(57) ABSTRACT

The invention concerns a sealing clip (10) for bags, foil tubes or the like, said sealing clip (10) comprising a wire section, a pre-curved clip base (12) and two clip legs (14) adjoining the latter on both sides. The two clip legs taper constantly from their clip base ends to their free ends. The invention also concerns a wire section for sealing clips of this type which tapers constantly towards both ends. The invention finally concerns a matrix (30) for sealing the sealing clip and having two slide channels (36, 38) which each narrow conically from an inlet point.

7 Claims, 7 Drawing Sheets

U.S. PATENT DOCUMENTS 912,955 A * 2/1909 Harber ..... 24/115 A
1,201,559 A * 10/1916 Columbia ..... 411/920
1,760,558 A * 5/1930 Klocke ..... 24/115 A
2,161,632 A * 6/1939 Nattenheimer ..... 411/920
2,879,512 A * 3/1959 Tipper ..... 29/818
3,055,010 A * 9/1962 Maestri ..... 24/115 A
3,400,433 A * 9/1968 Klenz ..... 24/30.5 W
3,430,320 A * 3/1969 Knuppel ..... 29/33.5
3,541,647 A * 11/1970 Marietta, Jr. ..... 24/30.5 W
3,564,663 A * 2/1971 Roberts ..... 24/30.5 W
3,584,347 A * 6/1971 Klenz ..... 24/30.5 W
3,611,509 A * 10/1971 Klenz ..... 24/30.5 W
3,728,774 A * 4/1973 Steller ..... 24/243.57
3,748,717 A * 7/1973 Leffler et al. ..... 29/211 D
3,793,688 A * 2/1974 Keating et al. ..... 29/33.5
4,087,889 A * 5/1978 Ohba et al. ..... 24/20 CW X
4,131,975 A 1/1979 Niedecker ..... 24/30.5 W
4,166,571 A * 9/1979 Niedecker ..... 24/30.5 W X
4,525,898 A 7/1985 Gallion et al. ..... 24/30.5 W
4,944,172 A * 7/1990 Evans ..... 24/30.5 W X
4,949,428 A * 8/1990 Simon ..... 24/30.5 R X
5,247,723 A * 9/1993 Niedecker ..... 24/30.5 W
5,305,628 A * 4/1994 Cluggish ..... 24/30.5 W X
5,953,794 A * 9/1999 Hanten et al. ..... 24/30.5 W

* cited by examiner

SEALING CLIP FOR BAGS AND TUBES, AND MATRIX FOR SEALING THE LATTER

BACKGROUND OF THE INVENTION

This invention relates to a sealing clip comprised of a wire section for bags, film tubes or the like, having a pre-bent clip base and two clip legs adjoining the latter on both sides. The invention furthermore relates to a wire section for the sealing clip and to a matrix having two sliding grooves for closing the sealing clip.

Simple sealing clips consisting of a wire section can be produced in that an endless wire is supplied to a sealing machine, a portion is cut off from the wire in the sealing machine, and the wire section is then for instance bent around a bag neck to be closed. It is likewise known to supply to a sealing machine not an endless wire, but wire sections already cut through. The wire sections may be straight or prebent to form a U. For magazining purposes, these wire sections are generally fixed one beside the other on a carrier strap, so that they form a magazine strand. The advantage of such sealing clips formed of a wire section resides in the easy manufacture of these sealing clips. The tightness of the closures which can be achieved with the known sealing clips formed of a wire section is, however, not satisfactory.

As a tool for closing the above-mentioned sealing clips there are usually used sealing machines which have a stamp and a matrix. The sealing clip pre-bent to form a U is first of all transferred from a magazine to the stamp and non-rotatingly guided. Subsequently, stamp and matrix are moved towards each other. During this movement, the sealing clip surrounds the packaging material gathered to form a neck. Then, the free ends of the legs of the sealing clip are the first to reach the matrix and in the course of the further movement are guided by sliding grooves in the matrix. In the process, the legs of the sealing clip are plastically deformed, so that there is finally obtained a more or less circularly closed sealing clip.

There are known matrixes which have two semicircular sliding grooves arranged parallel to each other. The main plane of the two sliding grooves is slightly inclined with respect to the main plane of the sealing clip, so that each sliding groove has an inlet point which lies in the main plane of the sealing clip. Main plane is understood to be that plane in which extends the center line of a sliding groove or the sealing clip. When the sealing clip guided by a stamp is moved towards the matrix for closure, each of the free leg ends enters one of the sliding grooves at a respective inlet point and is guided by the same on a helical path produced by the inclination of the sliding grooves. As a result, the two free ends of the sealing clip slide past each other during closure, so that upon closure they laterally overlap each other and rest against each other in parallel.

It is the object underlying the invention to provide a sealing clip comprised of a wire section, with which tighter closures can be achieved than with the sealing clips known so far.

SUMMARY OF THE INVENTION

In accordance with the invention, the solution of this object consists in a sealing clip as described above, which is characterized in that during closure the two clip legs taper constantly from their clip base ends to their free ends. This is based on the knowledge that during closure a sealing clip made of wire with a uniform cross-section always bends particularly in the vicinity of the arc sections between the legs and the clip base, because there the bending load is largest. Therefore, sealing clips consisting of a wire section of uniform cross-section never take on the circular shape ideal for tight closures. Since the wire cross-section of the inventive sealing clip tapers towards the legs, there is a much more uniform distribution of the bending load over the entire length of the legs, so that during closure the sealing clip approximately takes on the ideal circular shape.

DETAILED DESCRIPTION

Preferably, the clip base and the clip legs of the sealing clip have a round cross-section. Such sealing clip can be produced easily and inexpensively from a piece of round wire, which is partly stretched, so that the tapering legs are obtained.

In a preferred embodiment of the sealing clip the clip base has been preformed to form a circular arc. Preforming the clip base to form a circular arc promotes the approach of the sealing clip to the ideal circular shape during closure.

There is furthermore preferred a sealing clip which has a projection at the outer radius of the clip base. By means of such projection the sealing clip can be non-rotatingly guided in the stamp during closure.

The solution of the object underlying the invention also comprises a wire section for the inventive sealing clips which is characterized in that the wire section tapers constantly towards both ends. Such wire section solves the inventive object in particular in conjunction with those machines to which straight, not pre-bent wire sections are supplied. In this case, the individual wire sections are only pre-bent to form a U in the sealing machine (DE 41 20 440).

In the case of a straight wire section it is particularly advantageous when the cross-section of the wire section decreases constantly from the middle of the wire section to both ends, so that the wire section already tapers towards both sides in the vicinity of its future clip base. In this way, it is already during preforming that the wire section is subjected to a uniform bending load in the vicinity of the clip base, so that it easily takes on the shape of a circular arc.

BRIEF DESCRIPTION OF DRAWINGS

In accordance with the invention, a matrix as described above also contributes to the solution of the object, where the two sliding grooves of said matrix each narrow conically from an inlet point. Such matrix has the advantage that the tapering clip legs of the inventive sealing clip can be moved towards each other more tightly during closure than by means of conventional matrixes. In addition, the matrix can be designed more narrow, so that for the matrix only a smaller space must be provided in the sealing machine. Sealing clips closed by means of the inventive matrix require less space on the packaging casing gathered to form a neck, so that less packaging casing material is required for closure.

In a preferred embodiment of the matrix, the matrix is designed such that the centers of curvature of the sliding grooves are offset with respect to the center of the recess laterally reversed and their parallel axes are inclined less with respect to the axis of the recess than with respect to the axis of the rib. The result is that during closure the tapered ends of the clip legs are urged more firmly against the packaging casing gathered to form a neck and also laterally against each other.

Figure 1:
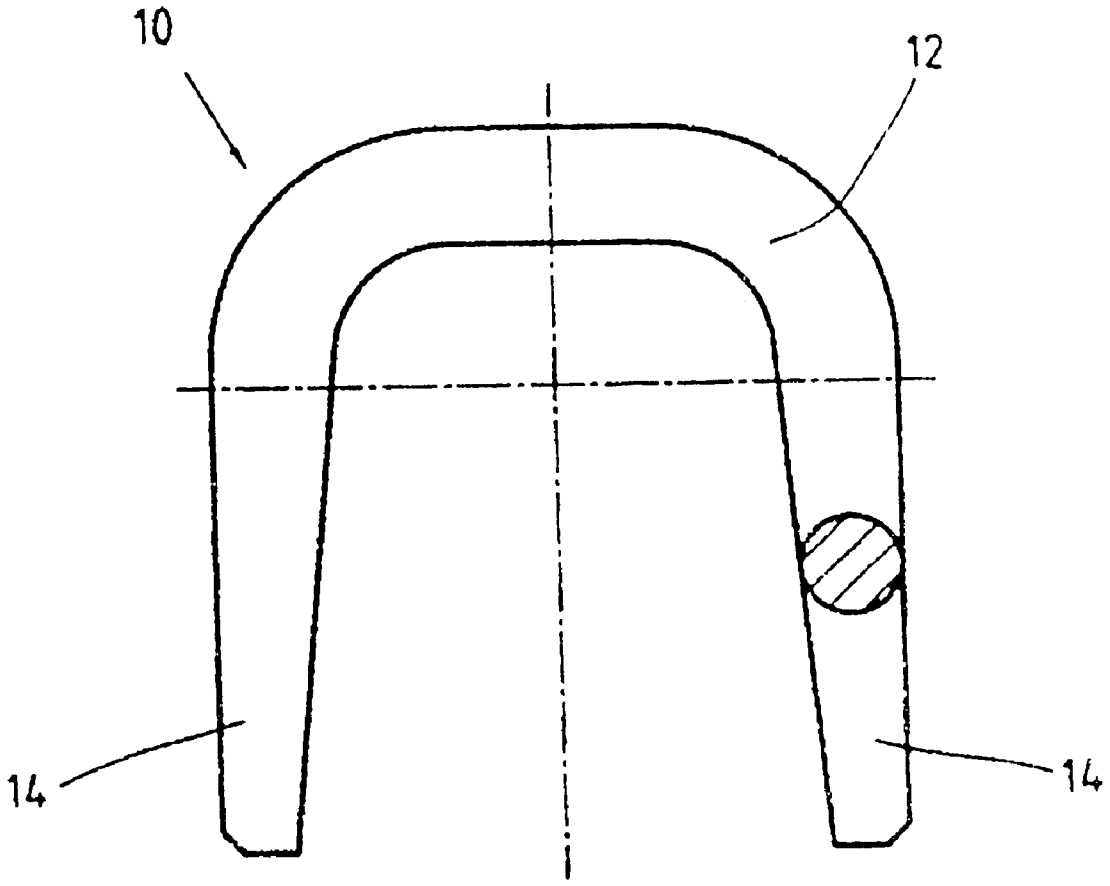
Figure 2:
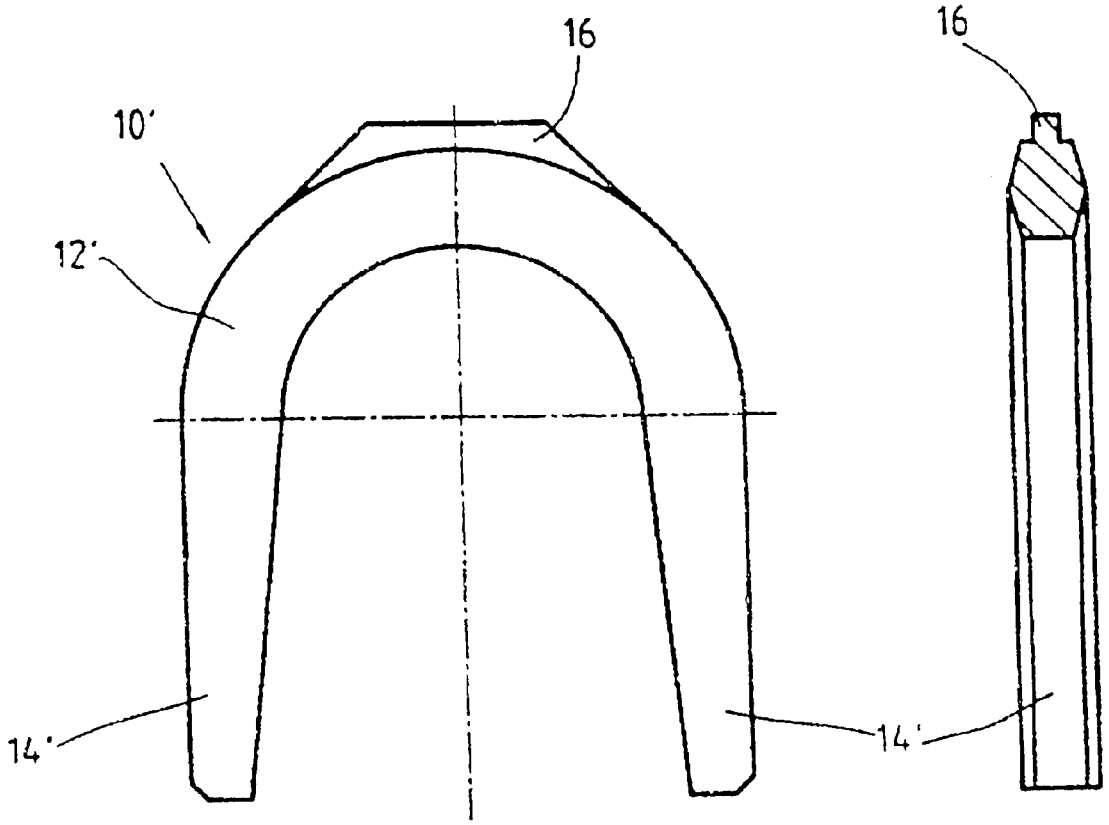
Figure 3:
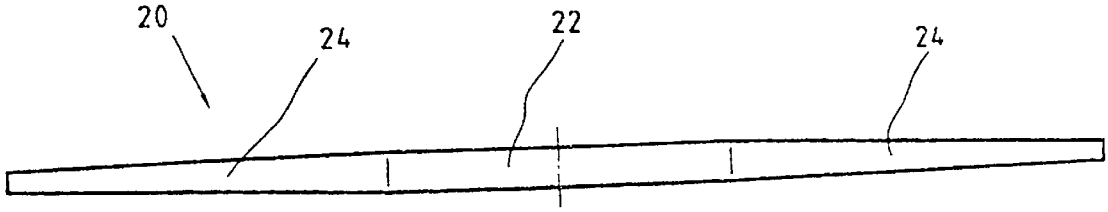
Figure 4:
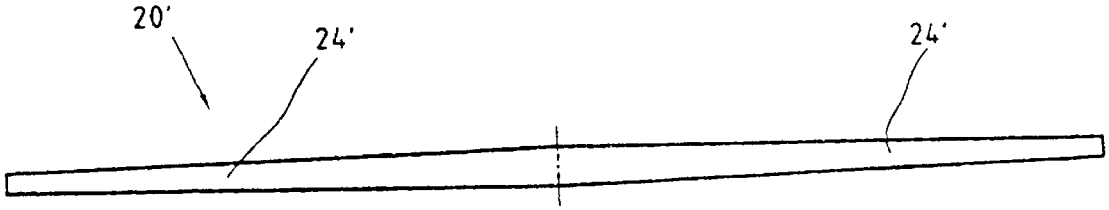
Figure 5A:
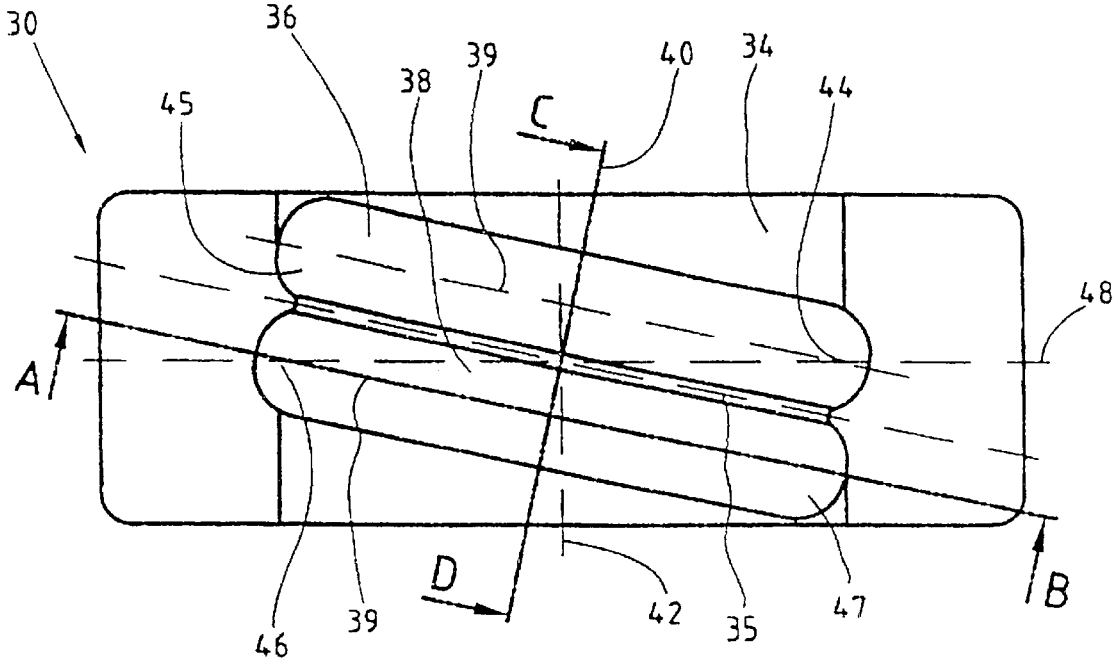
Figure 5B:
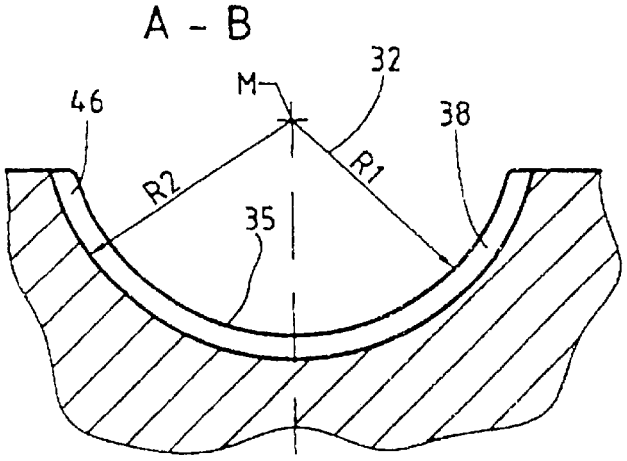
Figure 5C:
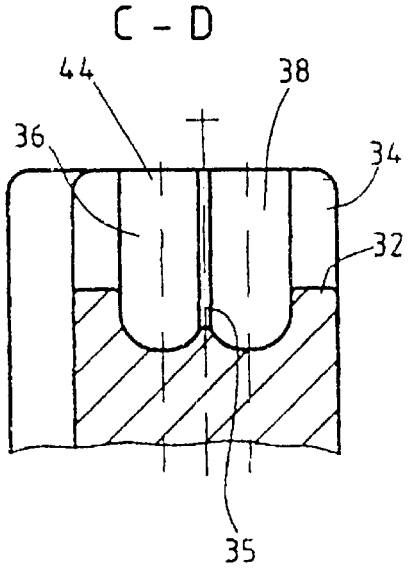
Figure 6A:
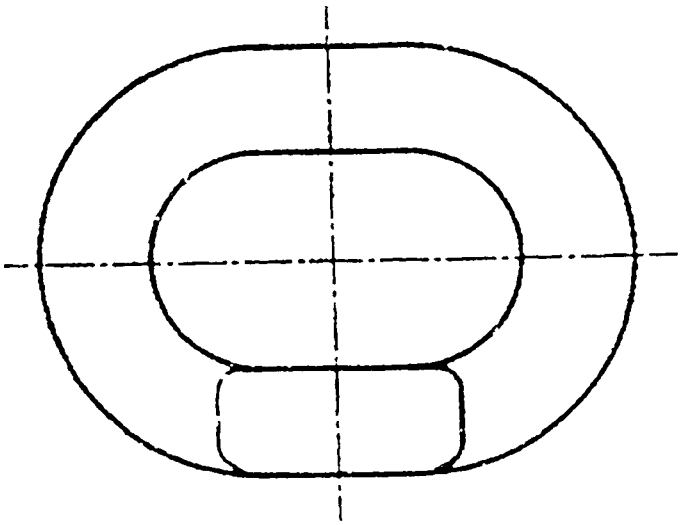
Figure 6B:
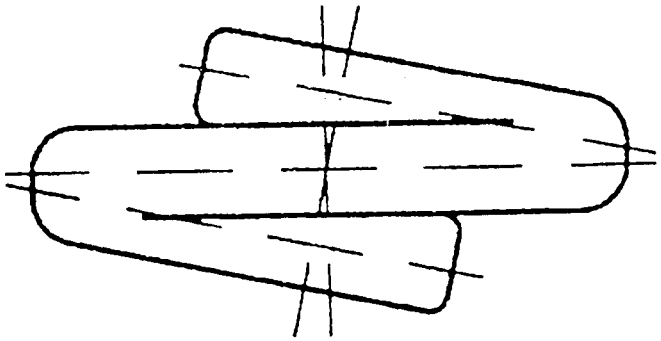
Figure 7A:
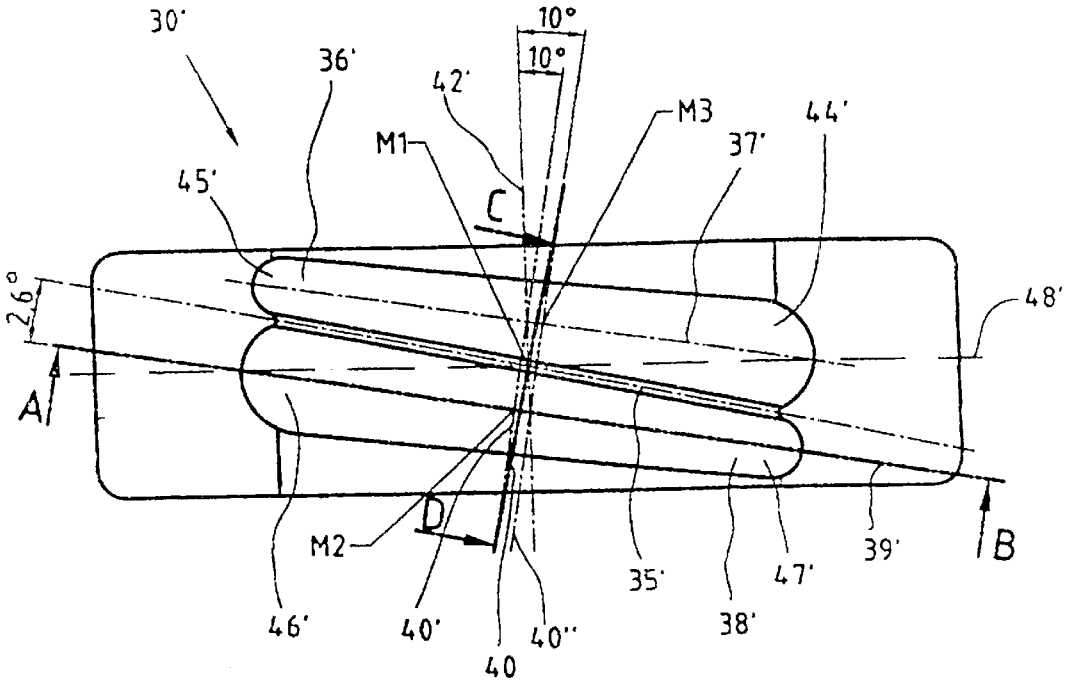
Figure 7B:
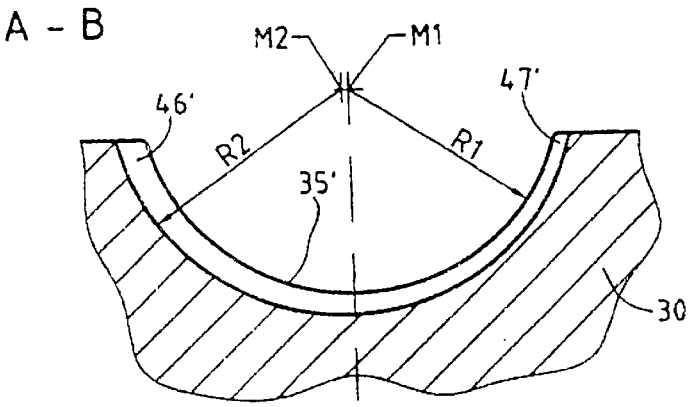
Figure 7C:
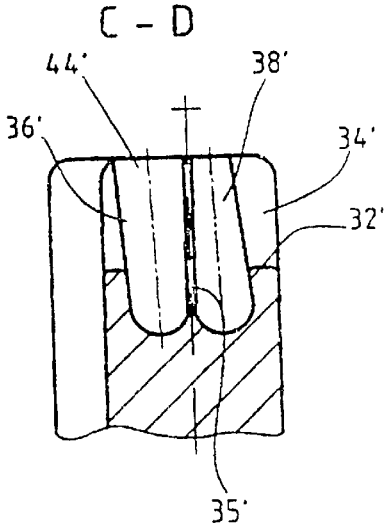
Figure 8A:
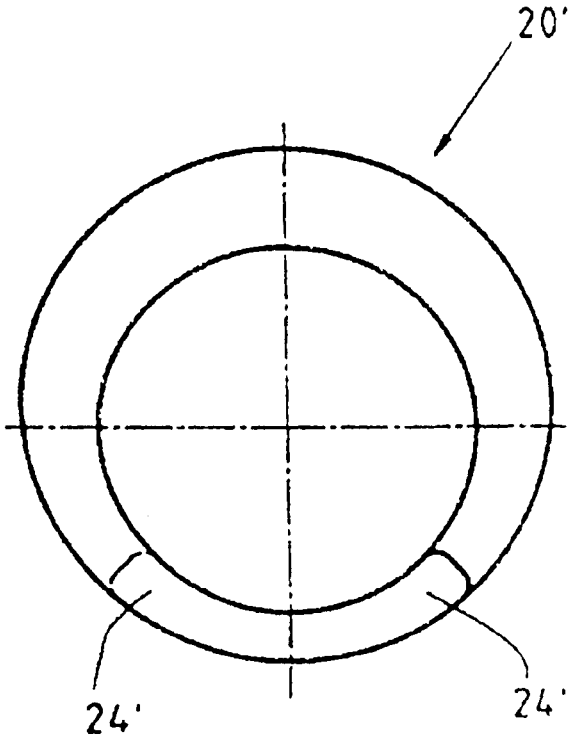
Figure 8B:
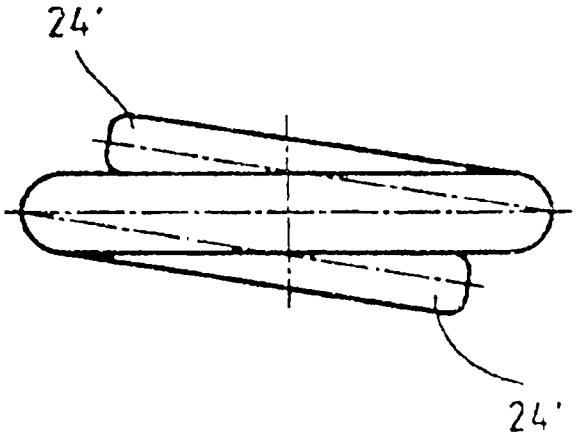

Embodiments of the invention will now be explained with reference to the drawings, wherein:

FIG. 1 shows a sealing clip in accordance with the invention with tapering legs and round cross-section;

FIG. 2 shows a modification of the sealing clip in accordance with FIG. 1 with a circular-arc-shaped clip base with projection;

FIG. 3 shows a wire section for the sealing clips in accordance with FIGS. 1 and 2;

FIG. 4 shows a variant of the wire section in accordance with FIG. 3;

FIGS. 5*a* to *c* show various views or partial sections of a known matrix for closing the sealing clips in accordance with FIGS. 1 and 2;

FIG. 6 shows a closed sealing clip in accordance with the prior art in a side view (and top view);

FIGS. 7*a* to *c* show a novel matrix in a top view and partial section;

FIG. 8 shows a sealing clip closed by means of the matrix in accordance with FIG. 7 with tapering legs.

The variant of a sealing clip 10 shown in FIG. 1 has a preformed clip base 12 to which a leg 14 is each joined on both sides. Clip base 12 and leg 14 each have a round cross-section. In the case of the legs 14, the same decreases constantly from their clip base ends to their free ends. When closing the sealing clip in accordance with FIG. 1, the conically tapering legs 14 ideally each form a carrier of the same bending load, so that they become uniformly round during closure.

It is provided that the leg ends are guided such during closure that they slide past each other, so that the free ends of the legs 14 in part laterally overlap each other upon closure. A sealing clip 10 closed in this way only to a small extent tends to unbend itself under the influence of the internal pressure exerted by the packaging material. In addition, different neck diameters are compensated in that the leg ends correspondingly overlap each other to different extents upon closure. In this way, a large bandwidth of different neck diameters can be covered with one sealing clip geometry. This simplifies stockkeeping, as only few variants of the sealing clip 10 must be kept in store.

FIG. 2 shows a variant of the sealing clip 10 in accordance with FIG. 1, where the clip base 12' is not flattened in its middle, but has the shape of a circular arc. In addition, the clip base 12' is provided with a projection 16 at its outer radius, which allows to precisely guide the sealing clip 10' during closure, in that the projection 16 engages in a corresponding groove of a closing tool. This prevents in particular a rotation of the sealing clip 10' during closure.

It can also be taken from FIG. 2 that the clip base 12' and the legs 14' do not have a round cross-section, but—with the exception of the area of the projection 16—a hexagonal one.

FIGS. 3 and 4 each show a wire section 20 and 20', respectively, from which sealing clips of the kind shown in FIG. 1 or similar sealing clips can be formed. The wire section 20 in accordance with FIG. 3 has a cylindrical center piece, to which end portions 24 conically tapering towards their ends are joined on both sides. The center piece 22 should be preformed to form a U, so that it forms a clip base as for instance that of the sealing clip 10 in accordance with FIG. 1. The end portions 24 of the wire section 20 then form the legs 14 of the sealing clip 10.

Preforming the wire section 20 to obtain the open sealing clip 10 can be effected outside the sealing machine, for instance at the location of the sealing clip manufacturer. The sealing clip is then supplied to the sealing machine in the preformed condition—possibly as part of a magazine strand.

Preforming the sealing clip 10 can, however, also be effected inside the sealing machine before the actual closing operation. In the latter case, a wire section is supplied to the sealing machine in the stretched condition. For this case, the wire section 201 in accordance with FIG. 4 is particularly suited. The wire section 20' tapers constantly from its middle to its two ends. Thus, it virtually comprises only two conical end portions 24'; a cylindrical center piece 22 as in the wire section 20 is omitted. In this way, the middle portion of the wire section 20', which forms the future clip base 12, already represents a carrier of the same bending load, which easily takes on a uniformly round shape when it is preformed in the sealing machine. The end portions of the wire section 20', which form the clip legs 24', remain stretched. They are only bent around the neck to be closed when the sealing clip is closed. Since the clip legs 24' also represent a carrier of uniform bending load, they also take on the ideal shape of a circular arc when they are closed.

FIGS. 5*a* to *c* show a known matrix 30 of a tool for closing sealing clips in accordance with FIGS. 1 and 2. FIGS. 5*b* and 5*c* represent the sections illustrated in FIG. 5*a*.

The matrix 30 has an impression in the form of a partly cylindrical recess 32. In the wall 34 thereof there have been milled two directly adjacent sliding grooves 36 and 38 extending parallel to each other. Both sliding grooves 36, 38 have the shape of a circular arc of the same radius, are also keyed in cross-section and between each other form a rib 35. In addition, the centers of both circular arcs lie on a common central axis 40, which intersects the cylinder axis 42 of the recess 32. The central axis 40 is inclined with respect to the cylinder axis 42 such (for instance under an angle of 12°) that the inlet points 44 and 46 of the sliding grooves 36, 38, i.e. their vertices, approximately lie in the central plane 48 of the matrix 30 extending vertically to the cylinder axis 42. The production of both sliding grooves 36, 38 is now effected by means of an integral milling cutter, which has been swivelled by the above-mentioned angle of inclination about the vertical axis defined by the intersection of the cylinder axis 42 with the central plane 48.

For closing a sealing clip 10, the same is supplied from a stamp onto the matrix 30. The free leg ends of the sealing clip 10 move into the two sliding grooves 36, 38 at the inlet points 44, 46 and during the further movement of the stamp are guided by the sliding grooves 36, 38 to the outlet points 45, 47. The clip legs 14 of the sealing clip 10 are bent to form a circular arc and at the same time are moved past each other in parallel by the sliding grooves 36, 38, so that the closed sealing clip in accordance with the prior art takes on the shape illustrated in FIG. 6 with laterally overlapping leg ends resting against each other in parallel.

If the matrix 30 of FIG. 5 would, however, be used for closing the sealing clip 10 of FIG. 1, the tapering clip leg ends would not be brought together go closely, that in the end they laterally rest against each other.

For closing the sealing clip 10 in accordance with FIG. 1, there is therefore preferably used the matrix 30' illustrated in FIG. 7. The matrix 30' also has two sliding grooves 36' and 38', whose main planes 37', 39' extend parallel to each other, but as compared to FIG. 5—with unchanged inclination of the rib 35'—are inclined legs with respect to the central plane 48'. At the same time, the centers M2 and M3 as well as the axes of rotation 40', 40"—vertical to the main planes 37', 39'—are offset with respect to each other in parallel, namely laterally reversed towards both sides of the axis 40, which extends under the same angle with respect to the axes of rotation 40', 40" which the rib 35' includes with the main planes 37', 39'.

This fact as well as the production of the sliding grooves 36', 38' by means of individual milling cutters offset with respect to each other by the distance M2–M3 does not alter the fact that the inlet points 44' and 46' of the sliding grooves 36', 38' lie in the central plane 48'. In contrast to the sliding grooves of the known matrixes (e.g. matrix 30 of FIG. 5), however, the sliding grooves 36' and 38' narrow constantly from their inlet points 44' and 46', so that in the ideal case the width of the sliding grooves 36' and 38' corresponds to the respective width of the conically tapering clip legs 14 of the sealing clip 10. As a result, the clip legs 14 are brought together more closely during closure, and when the sealing clip 10 is closed, they closely rest against each other laterally. This reduction of the width of the sliding grooves from the inlet point to the outlet point (with which corresponds the "swivelling back" of their main planes 37', 39' towards the central plane 48') leads to the fact that the width of the matrix 30'—transverse to the central plane 48'—can be clearly smaller than that of the known matrix 30 (FIG. 5), which has the advantages described above. It is furthermore advantageous that due to the above-described geometry each sliding groove tapers off towards its outlet point of a reduced depth, with the further consequence that during closure the legs 14 of the sealing clip 10 are urged more firmly against the packaging casing neck to be closed.

One of the many conceivable modifications of the matrixes 30 and 30' resides in providing sliding grooves which do not extend on a circular path, but on a helical path, so that the respective inlet point of a sliding groove lies on a larger radius than the corresponding end point of the sliding groove.

By means of the above described and other variations of the matrix, the shape of the closed sealing clip can be adapted to all kinds of applications.

FIG. 8 shows a side view of the result of a closing operation, when a sealing clip in accordance with FIG. 4 is processed with a matrix in accordance with FIG. 7.

What is claimed is:

1. A sealing clip for bags or film tubes, comprised of a wire section of round cross-section having a pre-bent clip base and two clip legs adjoining the clip base on both sides, wherein the cross-section of the two clip legs tapers constantly from the ends of the clip base to the free ends of the clip legs.

2. The sealing clip of claim 1, wherein the clip base is in the form of a circular arc.

3. The sealing clip of claim 1, wherein, on the outside of the clip base, a projection is provided.

4. A wire section for formation into the sealing clips of claim 1, wherein the wire section tapers constantly from the ends of the clip base portion to both free ends.

5. The wire section of claim 4, wherein the cross-section of the wire section decreases constantly from the middle of the wire section to its two free ends.

6. A matrix for closing the sealing clip of claim 1, which has a substantially partly cylindrical recess, and in the recess two parallel sliding grooves inclined with respect to the main plane of the clip base and curved corresponding to the recess, which sliding grooves each have an inlet point and an outlet point and, wherein the two parallel sliding grooves taper conically from their respective inlet point to their respective outlet point.

7. The matrix according to claim 6, wherein the centers of curvature of the sliding grooves are offset laterally reversed with respect to the center of the recess, and their parallel axes are inclined less with respect to the axis of the recess than the axis of the rib.

* * * * *